US006813849B2

(12) United States Patent
McGugan

(10) Patent No.: US 6,813,849 B2
(45) Date of Patent: Nov. 9, 2004

(54) GRADER MOLDBOARD ASSEMBLY

(75) Inventor: Edward McGugan, Holyrood (CA)

(73) Assignee: Volvo Motor Graders Limited, Goderich (CA)

( * ) Notice: Subject to any disclaimer, the term of this patent is extended or adjusted under 35 U.S.C. 154(b) by 0 days.

(21) Appl. No.: 09/883,307

(22) Filed: Jun. 19, 2001

(65) Prior Publication Data

US 2002/0000324 A1 Jan. 3, 2002

(51) Int. Cl.[7] ..... E01H 5/06
(52) U.S. Cl. ..... 37/266; 172/811
(58) Field of Search ..... 37/266; 172/799.5, 172/811, 780

(56) References Cited

U.S. PATENT DOCUMENTS 3,463,243 A * 8/1969 Fisher ..... 172/781
3,983,945 A * 10/1976 Hart et al. ..... 172/795
4,058,174 A * 11/1977 Atherton ..... 172/781
4,105,078 A * 8/1978 Gilbert ..... 172/781
4,249,323 A * 2/1981 Mathis et al. ..... 37/42 R
4,683,959 A * 8/1987 Clemens ..... 172/795
4,821,436 A * 4/1989 Slocum ..... 37/235
4,845,866 A * 7/1989 Ciula ..... 37/266
5,065,646 A * 11/1991 Rudolph, Jr. et al. ..... 76/101.1
5,076,370 A * 12/1991 Stubben et al. ..... 172/781
5,088,215 A * 2/1992 Ciula ..... 37/197
5,309,653 A * 5/1994 Pease et al. ..... 37/266
5,477,600 A * 12/1995 Houle et al. ..... 37/279
5,687,800 A * 11/1997 Wilkening ..... 172/811
5,860,230 A * 1/1999 Daniels ..... 37/232
6,134,813 A * 10/2000 Vickers ..... 37/196
6,154,986 A * 12/2000 Hadler et al. ..... 37/234
6,219,943 B1 * 4/2001 Kitchell ..... 37/232

* cited by examiner

*Primary Examiner*—Thomas B. Will
*Assistant Examiner*—Kristine Florio
(74) *Attorney, Agent, or Firm*—Blake, Cassels & Graydon LLP

(57) ABSTRACT

The moldboard support assembly for a motor grader reinforces the rear face of the moldboard by a series of vertical ribs. Upper and lower slide rails are secured to the ribs at a position outwardly of the rear face of the moldboard. This produces a series of gaps between adjacent ribs and between the rear face of the moldboard and the slide rails. These gaps allow material to clear away from the slide rails and thereby reduce bearing contamination of the slide rails.

3 Claims, 3 Drawing Sheets

GRADER MOLDBOARD ASSEMBLY

BACKGROUND OF THE INVENTION

The present invention relates to a moldboard assembly for a motor grader and in particular, to a slide arrangement for the moldboard of the motor grader.

Motor graders are used to grade a base material such as gravel or sand to provide a generally planar or contoured surface. It can be used to provide a consistent grade to a surface such as a road bed or road shoulder. These operations are accomplished by the accurate positioning and control of a moldboard which is suspended beneath the grader frame. The moldboard is slidable relative to a drawbar used to secure the moldboard to the grader frame. The securement of the moldboard beneath the grader frame should be designed to avoid wobble or excess clearance in the support arrangement as poor tolerance variations can very significantly affect the control the operator has on the moldboard and the precision that is possible in a grading operation.

Motor graders perform relatively precise grading operations, however, they are a type of construction equipment and therefore, must be rugged and able to withstand very significant forces. The equipment is fairly robust in construction, however, the slide support of a moldboard and the requirement to maintain tight tolerances remain a difficult design problem. A moldboard, when in use, moves stone, dirt or other particulate material and this material can pass over the face of the moldboard and contaminate the slide arrangement which is located behind the moldboard. Such contamination can increase the wear of the slide bearings used to support the moldboard. Given the environment in which the grader is used and the nature of grading the slide support arrangement behind the moldboard will be subject to this type of contamination.

Most grader moldboards have two horizontal slide rails secured on longitudinal channel type members secured to the rear of the moldboard. These channel members are horizontal, reinforce the moldboard, and typically support the slide rails. With this arrangement, dirt or other material which passes over the moldboard can collect and remains in close proximity to the slide rail.

U.S. Pat. Nos. 5,678,800 and 5,076,370 are typical of the designs described above.

The present invention overcomes a number of disadvantages of these prior moldboard support arrangements.

SUMMARY OF THE INVENTION

A moldboard assembly according to the present invention comprises a moldboard, upper and lower slide rails secured to the moldboard by a series of vertical ribs spaced in the length of the moldboard and secured thereto. The ribs are secured to the rails at positions intermediate the length of the rails leaving an upper portion of one of the slide rails and a lower portion of the other slide rail unobstructed thereby defining bearing slide surfaces which traverse said ribs.

According to an aspect of the invention, the ribs are secured to a lower portion of the upper rail and an upper portion of the lower rail.

According to further aspect of the invention, each rib is spaced from an adjacent rib by a distance of less than 12 inches.

In a preferred aspect of the moldboard assembly, each rib spaces the slide rails outwardly of the moldboard defining a series of gaps between said ribs and between said slide rails and said moldboard.

According to yet a further aspect of the invention, the ribs are located to define a gap between adjacent ribs of less than 7 inches.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
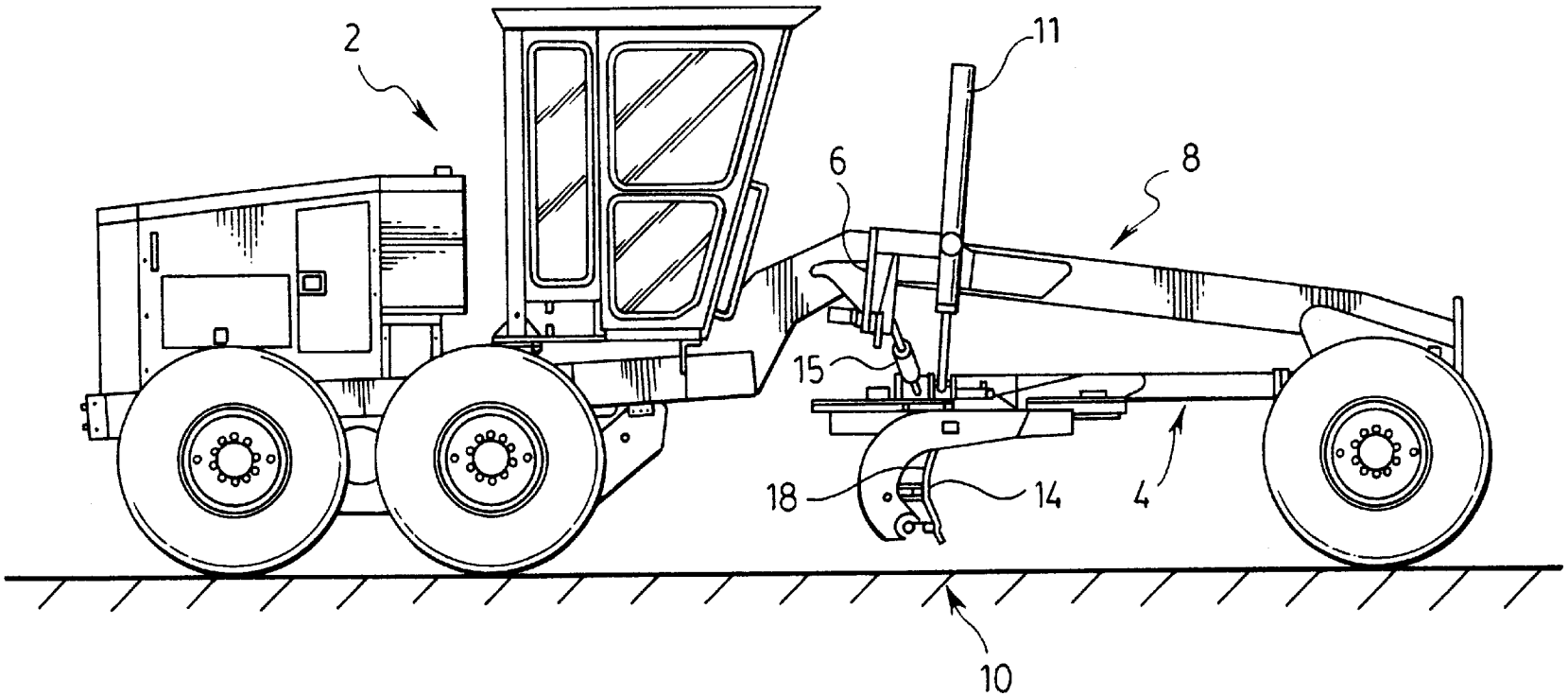
FIG. 1 is a side view of a motor grader with a moldboard supported beneath the grader.

The motor grader 2 shown in FIG. 1 has a drawbar 4 suspended beneath the grader and the moldboard assembly 10 is supported beneath the grader frame 8 by lift cylinders 11 and side shift cylinder 15. These cylinders in combination with a moldboard shift cylinder accurately locate the moldboard and maintain the position thereof beneath the grader frame.

Figure 2:
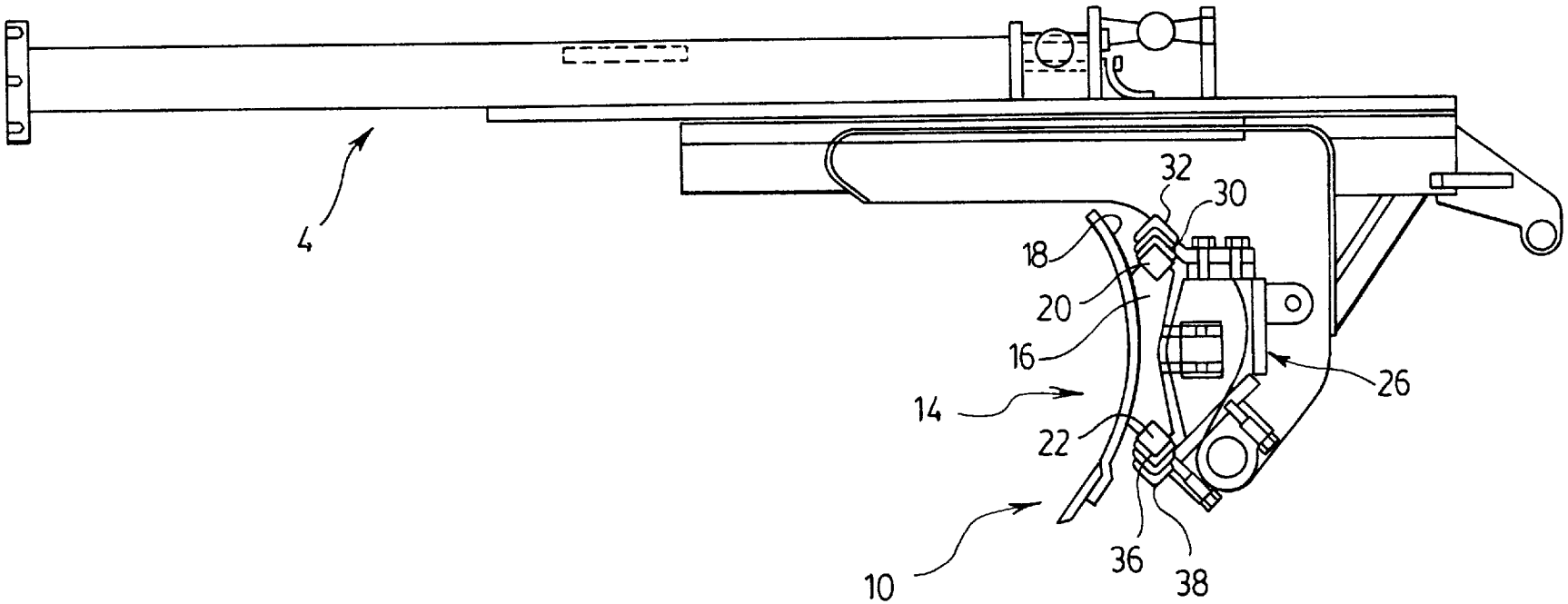
FIG. 2 is a side view of a drawbar of a motor grader with a support arrangement for the moldboard secured beneath the drawbar.
Figure 3:
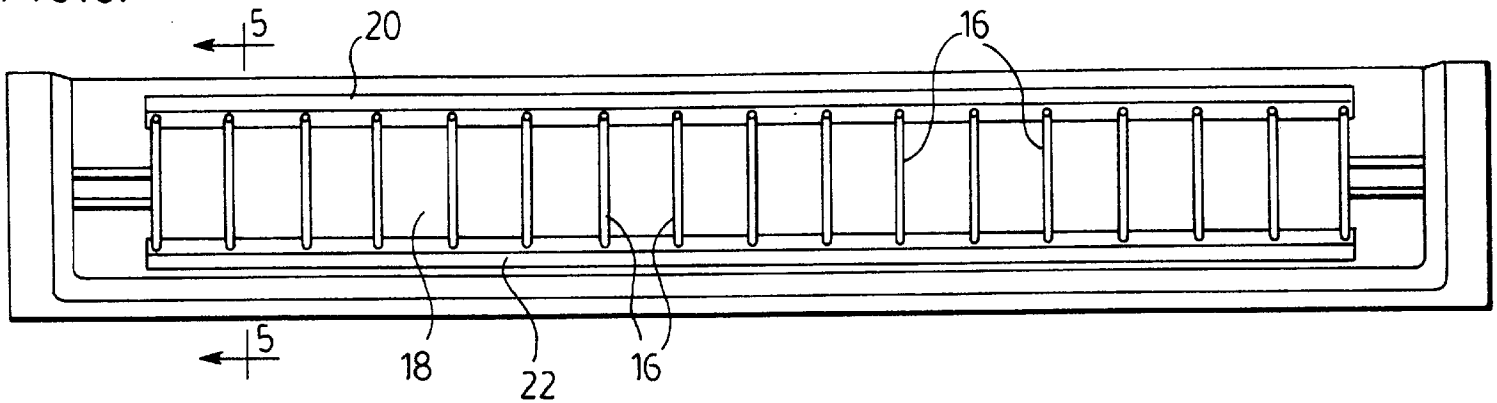
FIG. 3 is a rear view of the grader moldboard.
Figure 4:
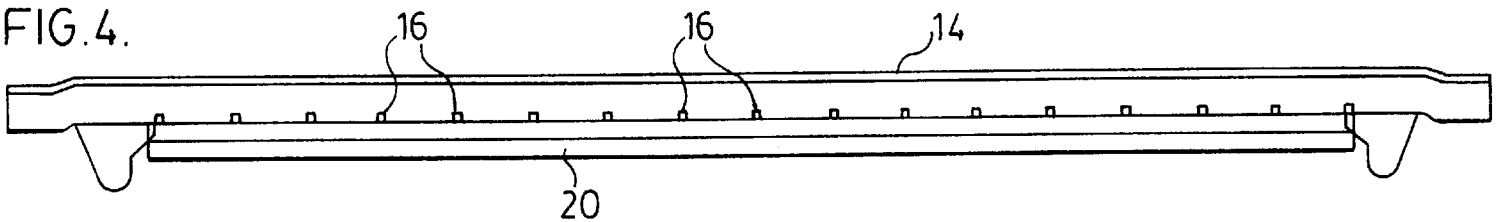
FIG. 4 is a top view of the grader moldboard.
Figure 5:
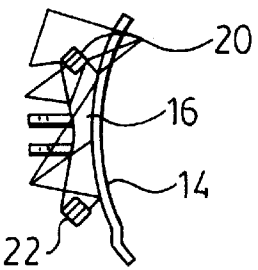
FIG. 5 is a sectional view taken along line A—A of FIG. 3.

Additional details of the moldboard assembly 10 are shown in FIG. 2. The moldboard 14 has on the back face 18, a series of vertical ribs 16. These vertical ribs are welded or otherwise secured to the back face of the moldboard and provide reinforcement of the moldboard.

The vertical ribs support the upper slide rail 20 and the lower slide rail 22 in a manner to allow the inverted V-shaped upper surface of the top slide rail and the V-shaped lower surface of the lower slide rail to act as bearing slide surfaces. The slide rails 20 and 22 are welded to the ribs and also reinforce the moldboard 14. The slide rails, in combination with the vertical ribs, oppose deformation about the vertical axis of the moldboard.

The series of vertical ribs 16 are preferrably spaced approximately 7 inches apart such that the upper and lower rails are supported every 7 inches. The moldboard assembly 10 includes a central support arrangement 26 which has attached thereto the upper slide bearing support arm 32 which locates the upper slide bearing 30 against the inverted V-shaped bearing slide surface of the upper slide rail 20. The lower slide bearing support arm 38 is secured to the central support arrangement 26 and locates and supports the lower slide bearing 36. Basically the V-shaped bearing surface of the lower slide rail is located within the lower slide bearing 36 and the upper slide bearing 30 is adjusted to allow sliding of the moldboard horizontally while reducing play in the fore or aft direction or in the vertical plane. In this way, the moldboard 14 is slidable relative to the central support arrangement 26 while being maintained to reduce wobble of the moldboard.

During grading, the moldboard 14 is subject to high loads and the moldboard support assembly must oppose these large forces. The vertical reinforcing by the series of ribs 16 welded to the moldboard assist in transmitting these loads to the drawbar 4. In addition the upper slide rail 20 and the lower slide rail 22 are substantial structural members welded to the ribs. These slide rails are made of square steel bars of a cross section two inch by two inch, and therefore provide longitudinal stiffening of the moldboard. This stiffening is enhanced due to the spacing of the rails at an upper and lower position as well as the outward spacing of the rails away from the back face of the moldboard.

Furthermore, the inclined surfaces of the slide rails encourage any dirt or particulate material which passes over the face of the moldboard and onto these rails to slide off the rails through a gap between the back face of the moldboard and the slide rails or off the free edge of the rails. The vertical ribs are preferrably located at approximately every 7 inches and only present a small surface on which material might tend to accumulate. It has been found that any such material quickly falls away. The top surface of the ribs could also be inclined to encourage material to fall away.

This self clearing of the slide rails has found to significantly increases or improves the life of the bearing slide members. This improvement in life renders the adjustability of the bearings less important in that they will maintain a tight tolerance longer and generally require infrequent service.

As shown in some of the drawings, there are five slide bearings. There are three upper slide bearings and two lower slide bearings. The extra upper slide bearing is centrally located. The purpose of the center, upper bearing in the illustrated embodiment, is to transmit forces from the blade tilt adjusting glide. This bearing is required in alternate embodiments where a different structure is used for implementing blade tilt adjustment. The bearings are approximately 10 inches in length and provide a large surface area to distribute the loads.

It has been found that the moldboard assembly as described above, is advantageously reinforced by the slide arrangement and the vertical support ribs welded at a host of positions intermediate the length of the moldboard also stiffen the moldboard. This assembly increases the strength and rigidity of the moldboard or allows the moldboard itself to be of less strength given that it is now reinforced by the ribs and the slide bars. The number of ribs connected by the rails are believed to cooperate to distribute loads.

The spacing of the ribs along the moldboard can vary as a function of the moldboard itself, the size of the slide rails, and the size of the ribs. Preferrably the ribs are positioned at least every 12 inches. If the ribs are spaced at a greater distance, the slide rails could be increased in size and/or the moldboard longitudinally stiffened. The sizing of the ribs, rails and bearings, and the number of ribs determine the stiffness and fatigue properties of the moldboard. It is preferred to over design the components to reduce deformation and fatigue and to provide a stiff, robust moldboard.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A moldboard assembly comprising a moldboard, upper and lower slide rails secured to said moldboard by a series of ribs secured to said moldboard and secured to said slide rails to space the rails to space the rails rearwardly of said moldboard with flow through gaps between said ribs and between said slide rails and said moldboards, said upper side rails on a lower surface being secured to said ribs leaving an upper surface of the upper rail unobstructed as a slide bearing surface extending in the length of the rail, said lower slide rail on an upper surface being secured to said ribs leaving a lower surface of the lower rail unobstructed as a slide bearing surface extending in the length of the rail, said slide rails further acting as structural stiffeners which in cooperation with said ribs reinforce said moldboard, said ribs including upper and lower notches shaped to receive and engage said upper and lower slide rails respectively.

2. A moldboard assembly as claimed in claim 1 wherein each notch is V shaped to contact two adjacent sidewalls of one of said slide rails and said slide rails are of a generally rectangular cross section.

3. A moldboard assembly as claimed in claim 2 wherein each slide rail is secured to each rib and said upper notches are on a top surface of said ribs and said lower notches are on a bottom surface of said ribs.

* * * * *

UNITED STATES PATENT AND TRADEMARK OFFICE

CERTIFICATE OF CORRECTION

PATENT NO. : 6,813,849 B2
APPLICATION NO. : 09/883307
DATED : November 9, 2004
INVENTOR(S) : Edward McGugan It is certified that error appears in the above-identified patent and that said Letters Patent is hereby corrected as shown below:

Column 4, Line 19, Claim 1: after “to space the rails”; delete “to space the rails”.

Column 4, Line 21, Claim 1: change “moldboards” to --moldboard--.

Column 4, Line 21, Claim 1: change “upper side” to --upper slide--.

Signed and Sealed this

Twenty-second Day of May, 2007

JON W. DUDAS
*Director of the United States Patent and Trademark Office*